US006254077B1

(12) United States Patent
Riley, Jr.

(10) Patent No.: US 6,254,077 B1
(45) Date of Patent: Jul. 3, 2001

(54) CLAMP AND V-BLOCK APPARATUS

(76) Inventor: William Robert Riley, Jr., 4301 S. Boxwood Pl., Tucson, AZ (US) 85730

( * ) Notice: Subject to any disclaimer, the term of this patent is extended or adjusted under 35 U.S.C. 154(b) by 0 days.

(21) Appl. No.: 09/552,833

(22) Filed: Apr. 20, 2000

(51) Int. Cl.[7] ..... B25B 1/24

(52) U.S. Cl. ..... 269/287; 269/902; 269/156; 269/99

(58) Field of Search ..... 269/902, 287, 269/254 CS, 156, 268, 99

(56) References Cited

U.S. PATENT DOCUMENTS

| | | | | |
|---|---|---|---|---|
| D. 333,826 | | 3/1993 | Giangrasso . | |
| 2,371,831 | * | 3/1945 | Leming | 269/902 |
| 3,218,059 | * | 11/1965 | Andrew | 269/902 |
| 3,423,885 | | 1/1969 | Crandall . | |
| 4,139,189 | * | 2/1979 | Wietrzyk | 269/902 |
| 4,201,376 | | 5/1980 | Philips . | |
| 4,340,211 | | 7/1982 | Chiappetti . | |
| 4,445,678 | | 5/1984 | George . | |
| 4,877,228 | * | 10/1989 | Ripert | 269/902 |
| 5,244,193 | | 9/1993 | Hehr . | |

* cited by examiner

*Primary Examiner*—Robert C. Watson

(57) ABSTRACT

A clamp and V-block apparatus for improving the use and structure of a V-block. The clamp and V-block apparatus includes includes a block member having a front and a plurality of sides with a first side having a V-shaped slot extending therein and being adapted to receive a work piece and with a second side having a T-shaped slot extending therein as viewed from the front and extending through and from the front to a back thereof with the second side being disposed generally opposite of the first side; and also includes a clamping member including an arcuate body member having flanges disposed at ends thereof and being removably and securely received in the block member, and further having a plurality of fasteners being threaded through the arcuate body member at spaced intervals and being adapted to engage and secure the work piece in the V-shaped slot; and further includes a plurality of fastening members lockingly extendable through the block member for securely fastening the work piece in the V-shaped slot.

13 Claims, 3 Drawing Sheets

CLAMP AND V-BLOCK APPARATUS

BACKGROUND OF THE INVENTION

1. Field of the Invention

The present invention relates to a clamping V-block and more particularly pertains to a new clamp and V-block apparatus for improving the use and structure of a V-block.

2. Description of the Prior Art

The use of a clamping V-block is known in the prior art. More specifically, a clamping V-block heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,445,678; U.S. Pat. No. 4,201,376; U.S. Pat. No. Des. 333,826; U.S. Pat. No. 5,244,193; U.S. Pat. No. 4,340,211; and U.S. Pat. No. 3,423,885.

While these devices fulfill their respective, particular objectives and requirements, the aforementioned patents do not disclose a new clamp and V-block apparatus. The inventive device includes a block member having a front and a plurality of sides with a first side having a V-shaped slot extending therein and being adapted to receive a work piece and with a second side having a T-shaped slot extending therein as viewed from the front and extending through and from the front to a back thereof with the second side being disposed generally opposite of the first side; and also includes a clamping member including an arcuate body member having flanges disposed at ends thereof and being removably and securely received in the block member, and further having a plurality of fasteners being threaded through the arcuate body member at spaced intervals and being adapted to engage and secure the work piece in the V-shaped slot; and further includes a plurality of fastening members lockingly extendable through the block member for securely fastening the work piece in the V-shaped slot.

In these respects, the clamp and V-block apparatus according to the present invention substantially departs from the conventional concepts and designs of the prior art, and in so doing provides an apparatus primarily developed for the purpose of improving the use and structure of a V-block.

SUMMARY OF THE INVENTION

In view of the foregoing disadvantages inherent in the known types of clamping V-block now present in the prior art, the present invention provides a new clamp and V-block apparatus construction wherein the same can be utilized for improving the use and structure of a V-block.

The general purpose of the present invention, which will be described subsequently in greater detail, is to provide a new clamp and V-block apparatus which has many of the advantages of the clamping V-block mentioned heretofore and many novel features that result in a new clamp and V-block apparatus which is not anticipated, rendered obvious, suggested, or even implied by any of the prior art clamping V-block, either alone or in any combination thereof.

To attain this, the present invention generally comprises includes a block member having a front and a plurality of sides with a first side having a V-shaped slot extending therein and being adapted to receive a work piece and with a second side having a T-shaped slot extending therein as viewed from the front and extending through and from the front to a back thereof with the second side being disposed generally opposite of the first side; and also includes a clamping member including an arcuate body member having flanges disposed at ends thereof and being removably and securely received in the block member, and further having a plurality of fasteners being threaded through the arcuate body member at spaced intervals and being adapted to engage and secure the work piece in the V-shaped slot; and further includes a plurality of fastening members lockingly extendable through the block member for securely fastening the work piece in the V-shaped slot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new clamp and V-block apparatus which has many of the advantages of the clamping V-block mentioned heretofore and many novel features that result in a new clamp and V-block apparatus which is not anticipated, rendered obvious, suggested, or even implied by any of the prior art clamping V-block, either alone or in any combination thereof.

It is another object of the present invention to provide a new clamp and V-block apparatus which may be easily and efficiently manufactured and marketed.

It is a further object of the present invention to provide a new clamp and V-block apparatus which is of a durable and reliable construction.

An even further object of the present invention is to provide a new clamp and V-block apparatus which is susceptible of a low cost of manufacture with regard to both materials and labor, and which accordingly is then susceptible of low prices of sale to the consuming public, thereby making such clamp and V-block apparatus economically available to the buying public.

Still yet another object of the present invention is to provide a new clamp and V-block apparatus which provides in the apparatuses and methods of the prior art some of the advantages thereof, while simultaneously overcoming some of the disadvantages normally associated therewith.

Still another object of the present invention is to provide a new clamp and V-block apparatus for improving the use and structure of a V-block.

Yet another object of the present invention is to provide a new clamp and V-block apparatus which includes includes a block member having a front and a plurality of sides with a first side having a V-shaped slot extending therein and being adapted to receive a work piece and with a second side having a T-shaped slot extending therein as viewed from the front and extending through and from the front to a back thereof with the second side being disposed generally opposite of the first side; and also includes a clamping member including an arcuate body member having flanges disposed at ends thereof and being removably and securely received in the block member, and further having a plurality of fasteners being threaded through the arcuate body member at spaced intervals and being adapted to engage and secure the work piece in the V-shaped slot; and further includes a plurality of fastening members lockingly extendable through the block member for securely fastening the work piece in the V-shaped slot.

Still yet another object of the present invention is to provide a new clamp and V-block apparatus that is easy and convenient to set up and use.

Even still another object of the present invention is to provide a new clamp and V-block apparatus that allows for a greater variety of work pieces to be worked on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
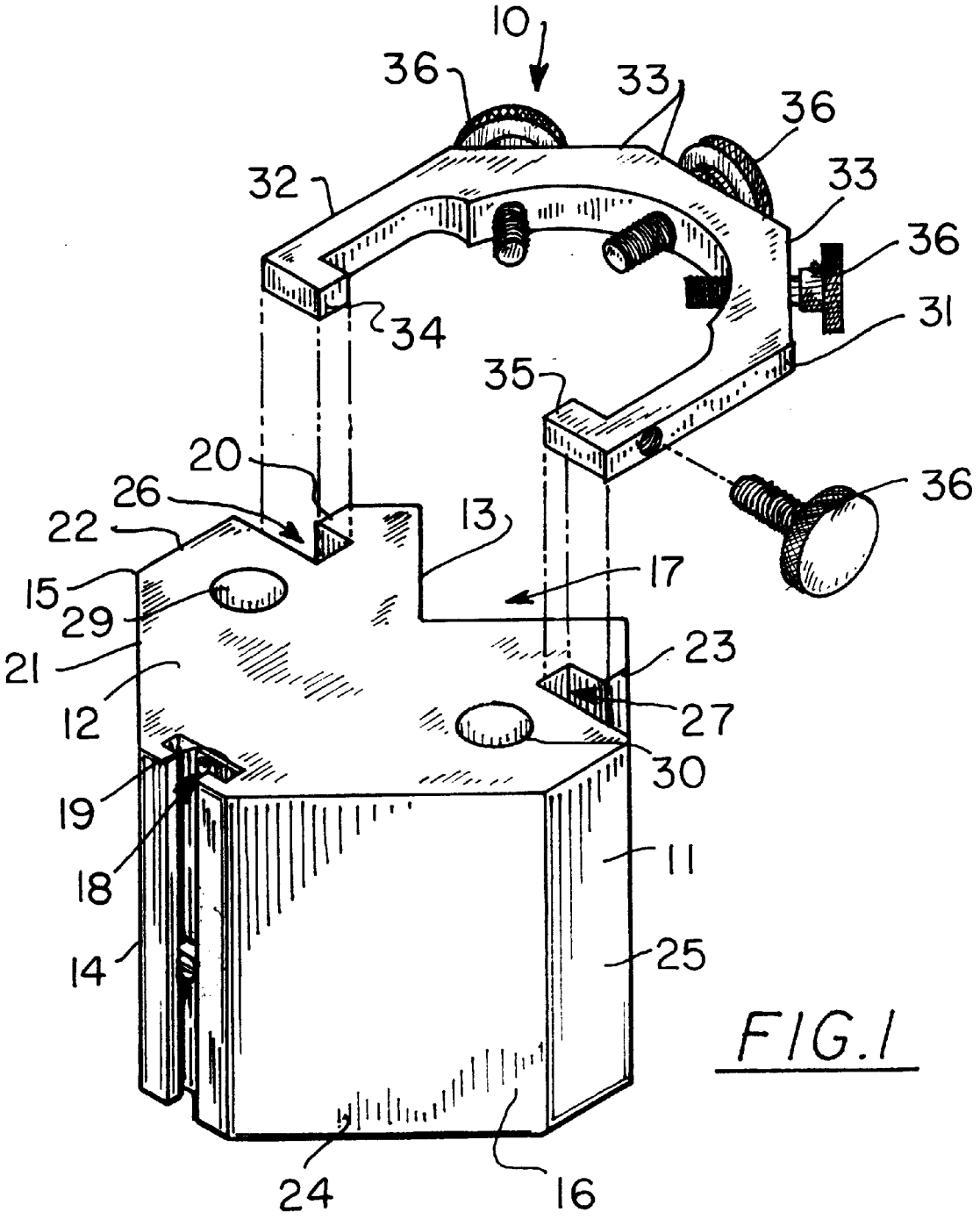
FIG. 1 is an exploded perspective view of a new clamp and V-block apparatus according to the present invention.
Figure 2:
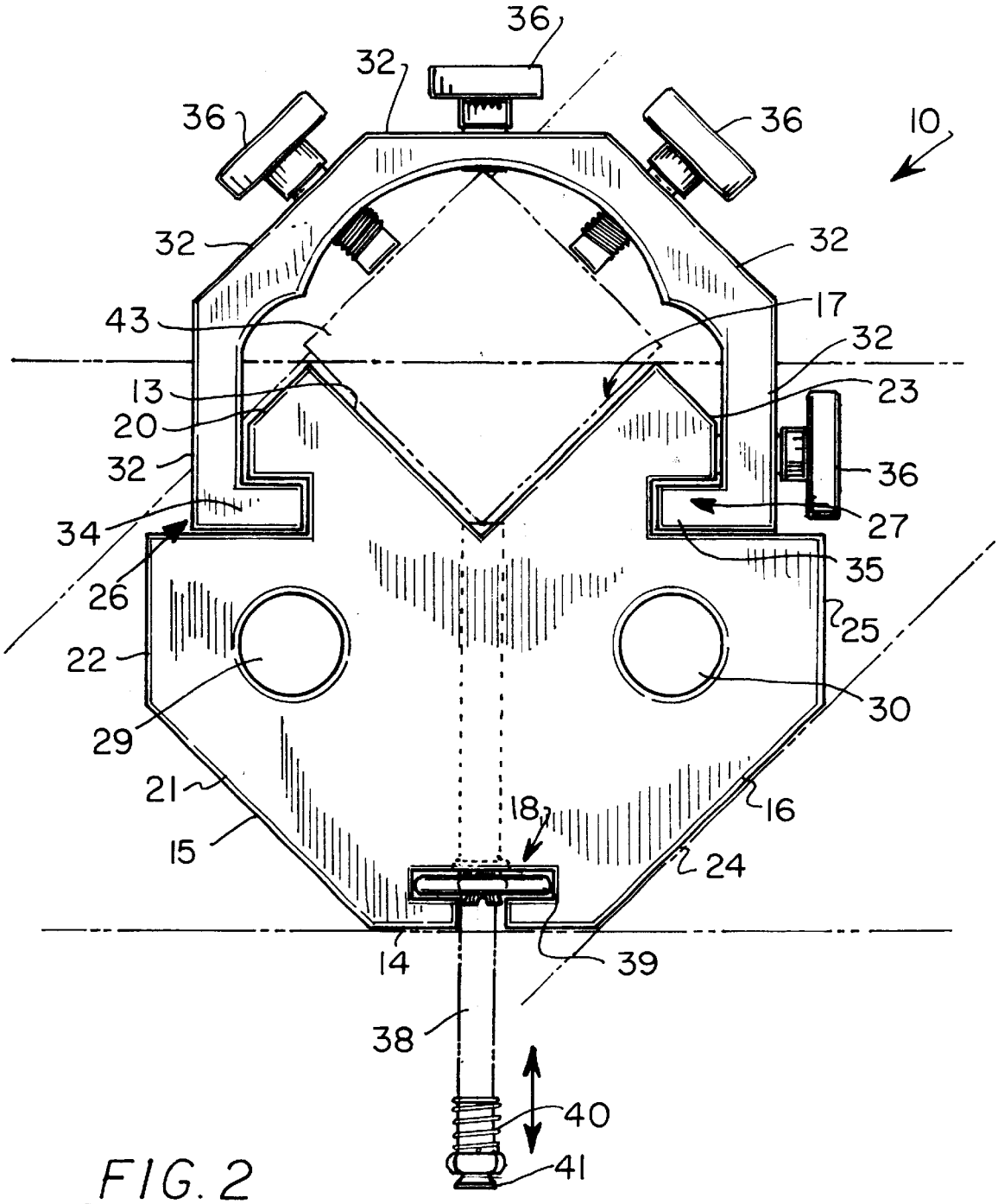
FIG. 2 is a front elevational view of the present invention shown in use.
Figure 3:
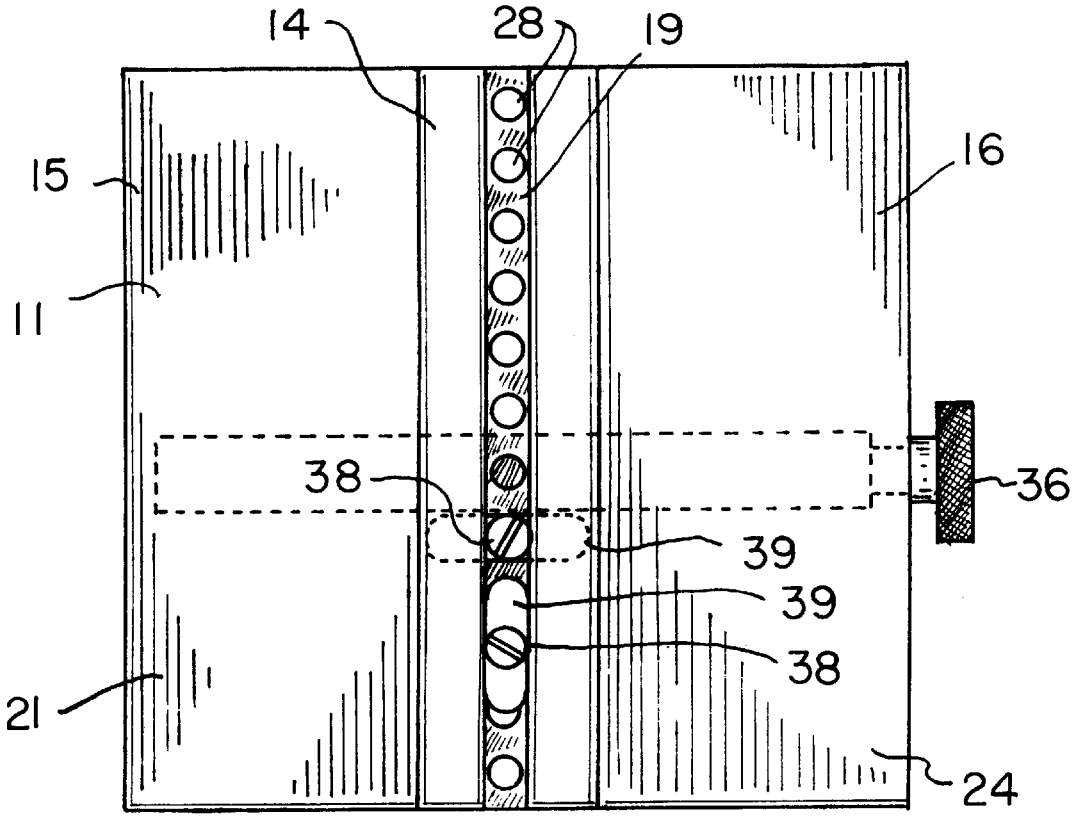
FIG. 3 is a bottom plan view of the present invention.
Figure 4:
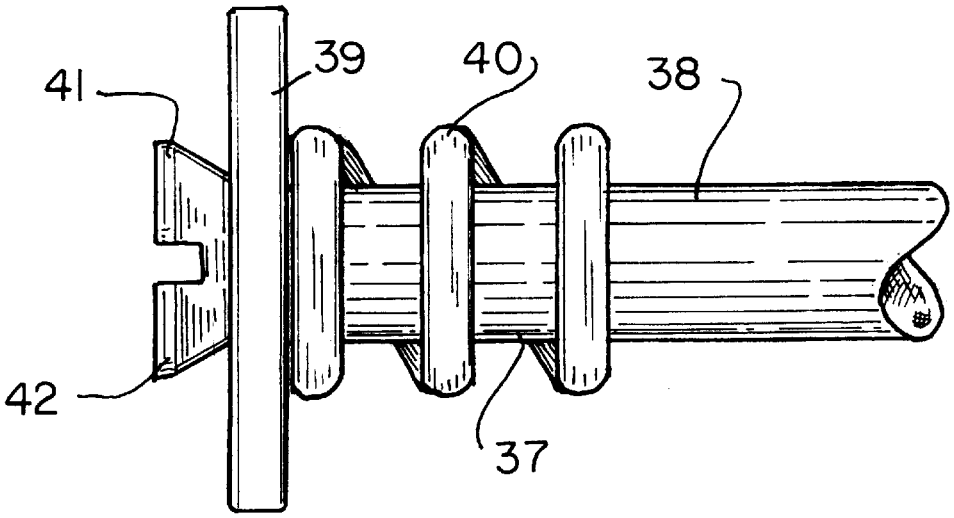
FIG. 4 is a detailed side elevational view of one of the fastening members of the present invention.

With reference now to the drawings, and in particular to FIGS. 1 through 4 thereof, a new clamp and V-block apparatus embodying the principles and concepts of the present invention and generally designated by the reference numeral 10 will be described.

As best illustrated in FIGS. 1 through 4, the clamp and V-block apparatus 10 generally comprises a block member 11 having a front 12 and a plurality of sides 13–16 including a first side 13 having a V-shaped slot 17 extending therein and being adapted to receive a work piece 43, and also including a second side 14 having a T-shaped slot 18 extending therein as viewed from the front and extending through and from the front 12 to a back thereof. The second side 14 is disposed generally opposite to the first side 13. The block member 11 includes a third side 15 and a fourth side 16 which are disposed generally opposite to one another. Each of the third and fourth sides 15,16 includes an intermediate portion 22,25, a first end portion 20,23 which is angled relative to the intermediate portion 22,25, and a second end portion 21,24 which is angled relative to the intermediate portion 22,25 and to the first end portion 20,23. The block member 11 includes a plurality of bores 28 being spaced apart and disposed parallel and extending through the block member 11 from the second side 14 to the first side 13 with the bores 28 extending through a wall 19 forming the T-shaped slot 18 in the second side 14 of the block member 11. The block member 11 further includes a plurality boreholes 29,30 extending therethrough from the front 12 to the back and being adapted to receive elongate members for fastening the block member 11 to a work table. Each of the first 20,23 and second portions 21,24 of the third side 15 and the fourth side 16 is angled approximately 45 degrees from a respective intermediate portion 22,25 with the block member 11 having a length of approximately 3 inches, a width of approximately 2½ inches and a thickness of approximately 2½ inches.

A clamping member 31 includes an arcuate body member 32 having flanges 34,35 integrally disposed at ends thereof and being removably and securely received in the block member 11, and further has a plurality of fasteners 36 being threaded through the arcuate body member 31 at spaced intervals and being adapted to engage and secure the work piece 43 in the V-shaped slot 17. Each of the first end portions 20,23 of the third 15 and fourth 16 sides includes a longitudinal slot 26,27 extending therein and extending from the front 12 to the back of the block member 11. Each of the longitudinal slots 26,27 is adapted to receive a respective one of the flanges 34,35 of the arcuate body member 31 for essentially securing and stabilizing the arcuate body member 31 about the block member 11. The flanges 34,35 extend inwardly of the arcuate body member 11 and are aligned with one another with the arcuate body member 11 having a plurality of outer sides 33 which are angled relative to one another to allow the fasteners 36 to engage and secure the work piece 43 from different angles. The arcuate body member 31 is essentially an inverted U-shaped.

A plurality of fastening members 37 are lockingly extendable through the block member 11 for securely fastening the work piece 43 in the V-shaped slot 17. Each of the fastening members 37 includes an elongate shaft 38 having a head portion 41 at one end thereof and being extendable through a selected one of the bores 28 for engaging and securing the work piece 43 in the V-shaped slot 17, and also includes a washer-like retaining member 39 which is mounted about a respective one of the elongate shafts 38 at the head portion 41 thereof and which is adapted to be received in the T-shaped slot 18 for locking and unlocking a respective one of the elongate shafts 38 within a selected one of the bores 28, and further includes a spring 40 mounted about a respective one of the elongate shafts 38 for biasing a respective one of the elongate shafts 38 out of a respective the bore 28. The head portion 41 of a respective one of the elongate shafts 38 is essentially a flat head 42. Each of the springs 40 is disposed between a respective one of the washer-like retaining members 39 and the wall of the T-shaped slot 18 for biasing a respective elongate shaft 38 out of a respective bore 28.

In use, the user either secures the block member 11 in a vice or securely attaches the block member 11 to a work table using the elongate members which are extended through the boreholes 29,30. The user then places a work piece 43, that he/she wants to perform work on, in the V-shaped slot 17 and secures the work piece 43 using the clamping member 31 and the fastening members 37 which are lockingly extended through selected bores 28 of the block member 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A clamp and V-block apparatus comprising:

a block member having a front and a plurality of sides, a first side of said sides having a V-shaped slot extending therein and being adapted to receive a work piece, a second side of said sides having a T-shaped slot extending therein-as viewed from said front and extending through and from said front to a back thereof, said second side of said sides being disposed generally opposite of said first side of said sides;

a clamping member including an arcuate body member having flanges disposed at ends thereof and being removably and securely received in said block member, and further having a plurality of fasteners being threaded through said arcuate body member at spaced intervals and being adapted to engage and secure the work piece in said V-shaped slot; and a plurality of fastening members lockingly extendable through said block member for securely fastening the work piece in said V-shaped slot.

2. A clamp and V-block as described in claim 1, wherein said block member includes a third side and a fourth side of said sides which are disposed generally opposite of one another, each of said third and fourth sides including an intermediate portion, a first end portion which is angled relative to said intermediate portion, and a second end portion which is angled relative to said intermediate portion and to said first end portion.

3. A clamp and V-block as described in claim 2, wherein each of said first end portions of said third and fourth sides includes a longitudinal slot extending therein and extending from said front to said back of said block member, each of said longitudinal slots being adapted to receive a respective one of said flanges of said arcuate body member for essentially securing and stabilizing said arcuate body member about said block member.

4. A clamp and V-block as described in claim 3, wherein said block member includes a plurality of bores being spaced apart and disposed parallel and extending through said block member from said second side to said first side.

5. A clamp and V-block as described in claim 4, wherein said bores extend through a wall forming said T-shaped slot in said second side of said block member.

6. A clamp and V-block as described in claim 5, wherein said block member further includes a plurality boreholes extending therethrough from said front to said back and being adapted to receive elongate members for fastening said block member to a work table.

7. A clamp and V-block as described in claim 6, wherein said flanges extend inwardly of said arcuate body member and are aligned with one another.

8. A clamp and V-block as described in claim 7, wherein said arcuate body member has a plurality of outer sides which are angled relative to one another to allow said fasteners to engage and secure the work piece from different angles.

9. A clamp and V-block as described in claim 8, wherein said arcuate body member is essentially an inverted U-shaped.

10. A clamp and V-block as described in claim 9, wherein each of said fastening members includes an elongate shaft having a head portion at one end thereof and being extendable through a selected one of said bores for engaging and securing the work piece in said V-shaped slot, and also includes a washer-like retaining member which is mounted about a respective one of said elongate shafts at said head portion thereof and which is adapted to be received in said T-shaped slot for locking and unlocking a respective one of said elongate shafts within a selected one of said bores, and further includes a spring mounted about a respective one of said elongate shafts for biasing a respective one of said elongate shafts out of a respective said bore.

11. A clamp and V-block as described in claim 10, wherein said head portion of a respective one of said elongate shafts is essentially a flat head.

12. A clamp and V-block as described in claim 11, wherein each of said springs are disposed between a respective one of said washer-like retaining members and said wall of said T-shaped slot for biasing a respective said elongate shaft out of a respective said bore.

13. A clamp and V-block apparatus comprising:

a block member having a front and a plurality of sides, a first side of said sides having a V-shaped slot extending therein and being adapted to receive a work piece, a second side of said sides having a T-shaped slot extending therein as viewed from said front and extending through and from said front to a back thereof, said second side of said sides being disposed generally opposite of said first side of said sides, said block member including a third side and a fourth side of said sides which are disposed generally opposite of one another, each of said third and fourth sides including an intermediate portion, a first end portion which is angled relative to said intermediate portion, and a second end portion which is angled relative to said intermediate portion and to said first end portion, said block member including a plurality of bores being spaced apart and disposed parallel and extending through said block member from said second side to said first side, said bores extending through a wall forming said T-shaped slot in said second side of said block member, said block member further including a plurality boreholes extending therethrough from said front to said back and being adapted to receive elongate members for fastening said block member to a work table, each of said first and second portions of said third side and said fourth side being angled approximately 45 degrees from a respective said intermediate portion, said block member having a length of approximately 3 inches, a width of approximately 2½ inches and a thickness of approximately 2½ inches;

a clamping member including an arcuate body member having flanges disposed at ends thereof and being removably and securely received in said block member, and further having a plurality of fasteners being threaded through said arcuate body member at spaced intervals and being adapted to engage and secure the work piece in said V-shaped slot, each of said first end portions of said third and fourth sides including a longitudinal slot extending therein and extending from said front to said back of said block member, each of said longitudinal slots being adapted to receive a respective one of said flanges of said arcuate body member for essentially securing and stabilizing said arcuate body member about said block member, said flanges extending inwardly of said arcuate body member and are aligned with one another, said arcuate body member having a plurality of outer sides which are angled relative to one another to allow said fasteners to engage and secure the work piece from different angles, said arcuate body member being essentially an inverted U-shaped; and a plurality of fastening members lockingly extendable through said block member for securely fastening the work piece in said V-shaped slot, each of said fastening members including an elongate shaft having a head portion at one end thereof and being extendable through a selected one of said bores for engaging and securing the work piece in said V-shaped slot, and also including a washer-like retaining member which is mounted about a respective one of said elongate shafts at said head portion thereof and which is adapted to be received in said T-shaped slot for locking and unlocking a respective one of said elongate shafts within a selected one of said bores, and further including a spring mounted about a respective one of said elongate shafts for biasing a respective one of said elongate shafts out of a respective said bore, said head portion of a respective one of said elongate shafts being essentially a flat head, each of said springs being disposed between a respective one of said washer-like retaining members and said wall of said T-shaped slot for biasing a respective said elongate shaft out of a respective said bore.

* * * * *